United States Patent [19]

Cottee

[11] Patent Number: 4,783,069

[45] Date of Patent: Nov. 8, 1988

[54] SKI MACHINE

[75] Inventor: John J. Cottee, Kanata, Canada

[73] Assignee: Dryland Kinetics, Inc., Kanata, Canada

[21] Appl. No.: 28,776

[22] Filed: Mar. 23, 1987

[51] Int. Cl.[4] ..... A63B 69/18

[52] U.S. Cl. ..... 272/97; 272/136

[58] Field of Search ..... 272/97, 72, 142, 133, 272/135, 136, 72, 137; 434/253

[56] References Cited

U.S. PATENT DOCUMENTS

| | | | |
|---|---|---|---|
| 2,906,532 | 9/1959 | Echols | 272/97 X |
| 3,511,499 | 5/1970 | Schawalder | 272/142 X |
| 3,606,318 | 9/1971 | Gilstrap | 272/72 X |
| 3,745,547 | 8/1973 | Walker | 272/135 X |
| 4,092,787 | 6/1978 | Kaempfen | 272/97 X |
| 4,396,189 | 8/1983 | Jenkins | 272/97 |
| 4,595,195 | 6/1986 | Miehlich | 272/97 |

FOREIGN PATENT DOCUMENTS

| | | | |
|---|---|---|---|
| 23115 | of 1906 | Austria | 272/97 X |
| 1213913 | 11/1986 | Canada . | |
| 0886917 | of 1981 | U.S.S.R. | 272/97 |

*Primary Examiner*—Ronald L. Frinks
*Assistant Examiner*—David J. Bender
*Attorney, Agent, or Firm*—W. Charles Kent

[57] ABSTRACT

An exercising and training apparatus particularly for use for training for alpine skiing. The apparatus comprises a frame having a platform pivotably secured to the frame for movement from side-to-side through a convex arcuate path to provide lateral motion for the user's feet and an accentuated degree of forced vertical motion. At the same time the platform tilts to the outside as it moves through its arcuate path. The platform is associated with spring biasing means to increase the resistance against sideways movement of the platform increasingly with sideways movement. The apparatus according to the present invention closely duplicates the motion and rhythm required in alpine skiing and thus improves skiing techniques as it strengthens the user's leg muscles.

17 Claims, 6 Drawing Sheets

SKI MACHINE

The present invention relates to an exercising and training apparatus particularly for use for exercising and training for alpine skiers.

BACKGROUND OF THE INVENTION

There have been numerous devices which have been previously developed to enable an alpine skier to train and exercise through simulation of some of the motions and forces of alpine skiing. Many of these prior art devices have consisted of carriages which move from side-to-side on rails under urging from a user supported on the carriage. Examples of such constructions are illustrated for example in Canadian Patent No. 886,148 of Schurch issued Nov. 16, 1971, Canadian Patent No. 862,613 of Ossenkop issued Feb. 2, 1971 and U.S. Pat. No. 4,607,839 of Knudson issued Aug. 26, 1986. Another form of device currently in the marketplace particularly for exercising of alpine skiers is a trampoline device in the form of a wide V, having ski pole handles secured to the frame of the device by which a user supports himself or herself in bouncing from one side to the other on the trampoline.

Another device of background interest is described and illustrated in Miehlich U.S. Pat. No. 4,595,195 issued June 17, 1986. There, a ski training apparatus is described in which a pair of ski boot supporting platforms are mounted on a seesaw platform which is itself centrally pivotally mounted on a swaying frame. The swaying frame swings, in horizontal fashion, on a main frame by means of elongated links extending between and secured to the swaying frame and main frame in the form of a parallelogram. Springs are provided to offer resistance to the swaying frame as it sways away from a midpoint.

Another device of a somewhat similar nature currently being marketed comprises a main support frame to which a pair of foot supporting arched members are pivotally supported for sideways pivotal movement. Spring urged bumpers meet the outer pivoting frame members at the bottom of their sideways movement to prevent them from pivoting sideways beyond a certain degree and to force them to return past the upper most, neutral position and then to the other side. This device provides a good sideways and vertical motion for a training device, in that the feet form a convex arch as they move from side-to-side.

It is an object of the present invention to provide a ski training and exercise device which will simulate, as realistically as possible, the sequence of motions of alpine skiing while at the same time improving the strength, balance, coordination and rhythm which are required for the smooth and natural motion of parallel alpine skiing. It is a further object of the present invention to provide such a device which is easy to operate and relatively inexpensive to construct. It is yet a further object of the present invention to provide such a device which is adjustable to many different weights of users and conditions of use.

SUMMARY OF THE INVENTION

In accordance with the present invention there is provided an exercising and training apparatus particularly for use for training alpine skiers. The apparatus comprises a rigid frame and a platform for the feet of a user. The platform support is pivotably secured to and extends between the platform and the frame to permit the platform to move, during operation from side-to-side, from a central position on a central transverse plane, through a convex arcuate path, and to provide forced lateral motion with an accentuated degree of forced vertical motion for the user's feet. The platform support also tilts the platform during operation to the outside as it moves through its arcuate path. A biasing means is secured to the frame and mechanically associated at all times with the platform to provide increased resistance to the motion of the platform as it moves, during operation, an increased distance sideways in one direction away from the transverse plane and to finally stop that sideways movement and cause the platform to move in the opposite direction. A rigid user support is secured to the frame to be gripped by the user during operation of the apparatus.

In a preferred embodiment of the present invention the platform support means comprises a pair of elongated bar means pivotably secured to the base and platform and spaced from each other to form, when the platform is in central position, a trapezoid. As well, in a preferred embodiment of the present invention, the biasing means comprises an elongated extension spring means, one end of which is secured to the frame and the other end of which is secured by cable means to the platform support means.

The device according to the present invention comprises very few moving parts and hence is simple and economical to construct and reasonably lightweight and portable. It enables the development of significant lateral motion for the user's feet together with an accentuated degree of forced vertical motion against the increasing forces generating by the biasing means as the platform moves to the lateral extent of its sideways motion. This enables realistic simulation of the sequence of motions during turns in alpine skiing, including the shifting of weight as the skier turns. The device also develops strength, balance and co-ordination as required for alpine skiing.

BRIEF DESCRIPTION OF THE DRAWINGS

These and other objects and advantages of the invention will become apparent upon reading the following detailed description and upon referring to the drawings in which.

Figure 2:
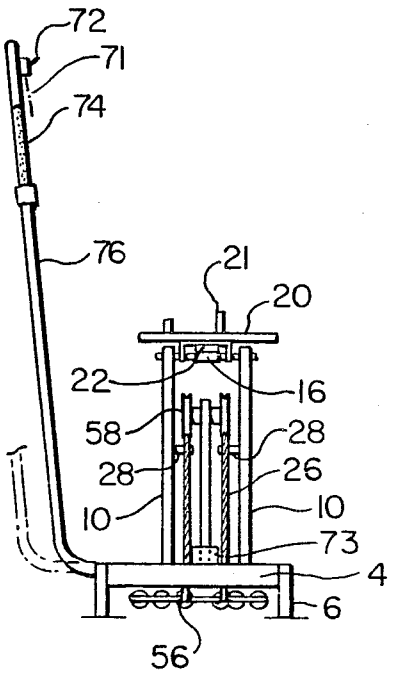
FIG. 2 is a side view of the apparatus of FIG. 1.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 1:
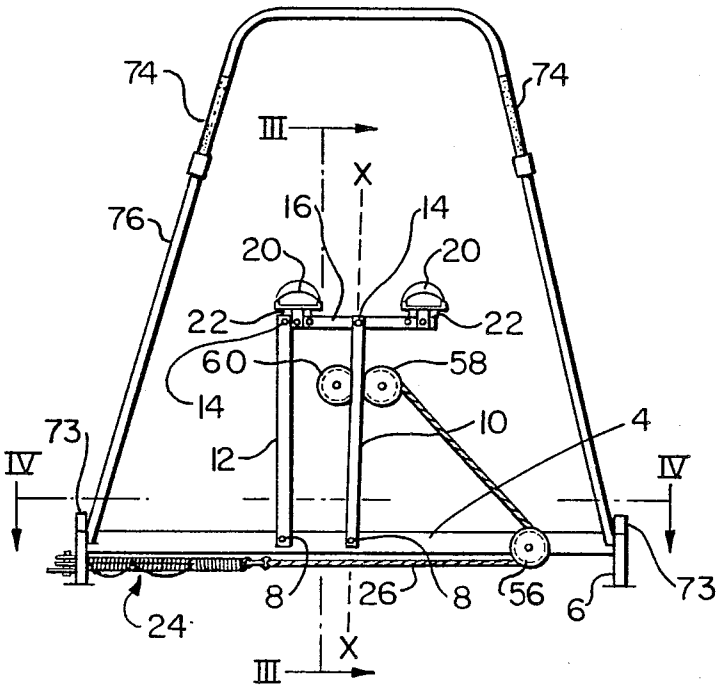
FIG. 1 is a front view of an example embodiment of the apparatus in accordance the present invention.
Figure 1A:
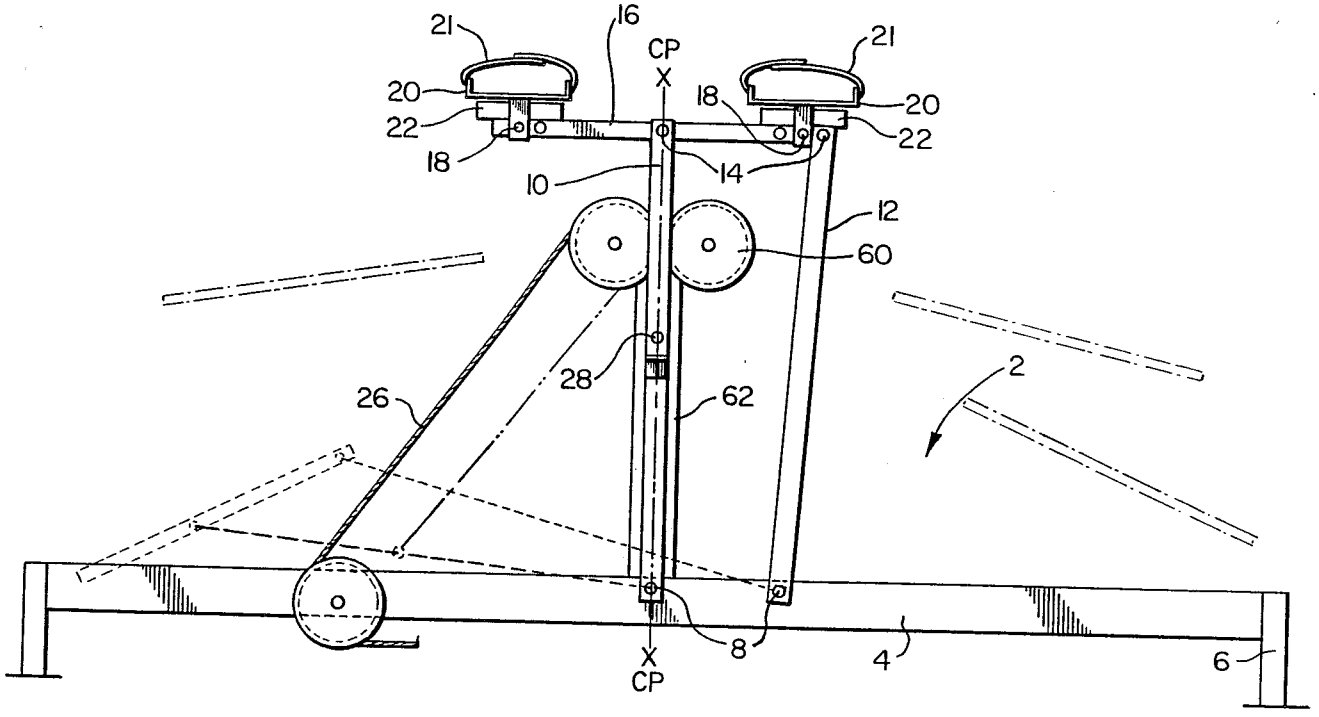
FIG. 1A on the second page of drawings is an enlarged partial rear view of the apparatus of FIG. 1.

Turning to FIG. 1 there is illustrated a training and exercising apparatus 2 in accordance with the present invention, comprising a rigid frame 4 having appropriate legs 6 to support the frame on any desired surface. Also rigidly secured to frame 4 by means of axles 8 are a pair of centrally disposed main support bars 10, one positioned transversely behind the other, and a pair of offset support bars 12, again one of bars 12 being transversely positioned behind the other. The upper ends of support bars 10 and 12 are pivotably secured by axles 14 to a platform 16 as illustrated. Support bars 10 are slightly shorter than support bars 12. Support bars 10 and offset support bars 12, as can be seen when the platform is in central position as illustrated in FIG. 1, form a trapezoid, being spaced apart a greater distance by axles 14 at their upper ends than axles 8 at their lower ends. When the platform is in this central position, a central vertical plane X-X passes through main support bars 10 and through the centre of platform 16. In operation, the platform moves from side-to-side with respect to this plane. Thus, as the platform moves from side-to-side away from its central position, it passes through a convex arcuate path, while the platform 16 automatically tilts increasingly to the outside as the platform approaches the limits of its movement to either side (phantom FIG. 1A).

Pivotably secured to platform 16 at pivots 18 are a pair of foot bed supports 20, one for each of the user's feet. Straps 21 are associated with foot beds 20 to secure the user's feet in position in the foot beds during operation of the device. The foot beds 20 each may tilt sideways, independently from the other, away from the horizontal rest position shown, for example, in FIG. 1. Resistance to that tilting motion is provided by rubber blocks 22 positioned beneath the foot beds and supported on platform 16.

Figure 3:
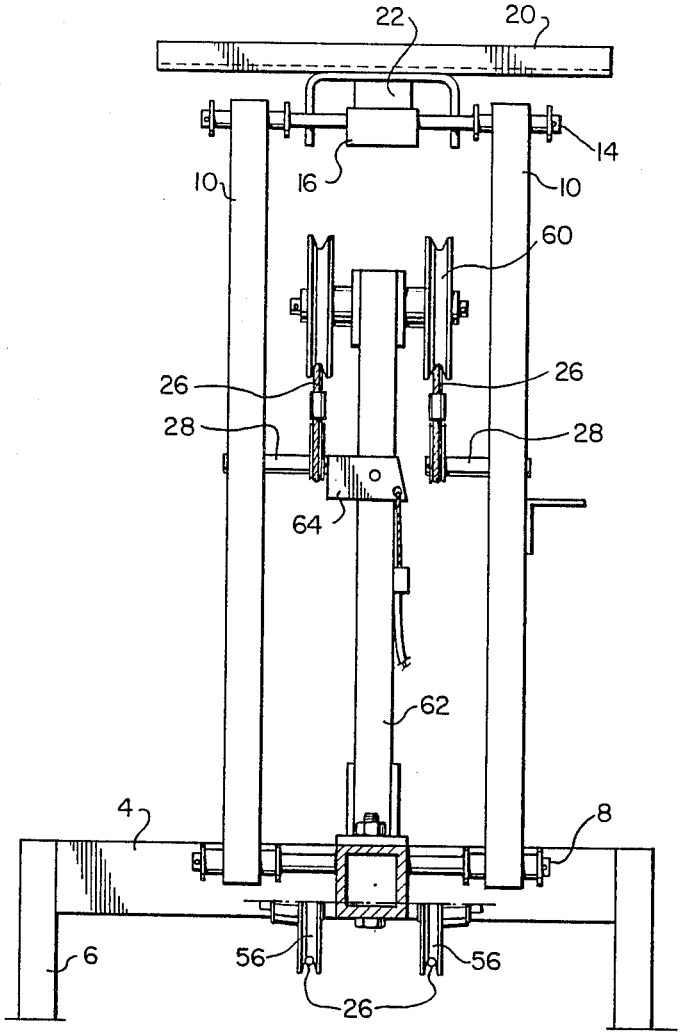
FIG. 3 is an enlarged partial section view along line III—III of FIG. 1.
Figure 4:
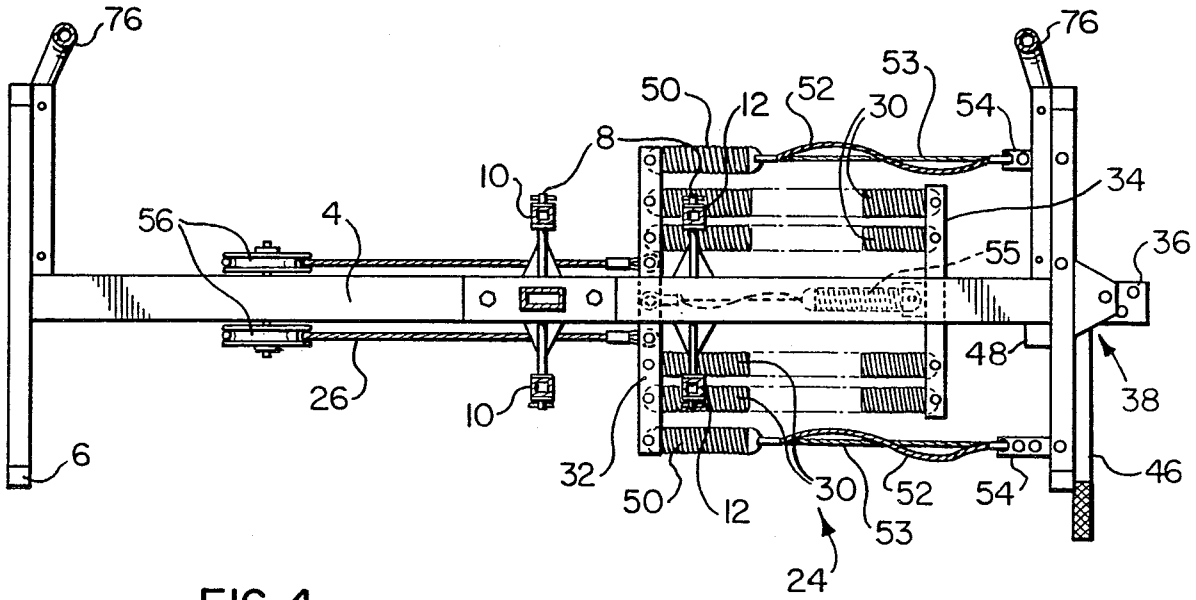
FIG. 4 is a section view along IV—IV of FIG. 1.
Figure 5:
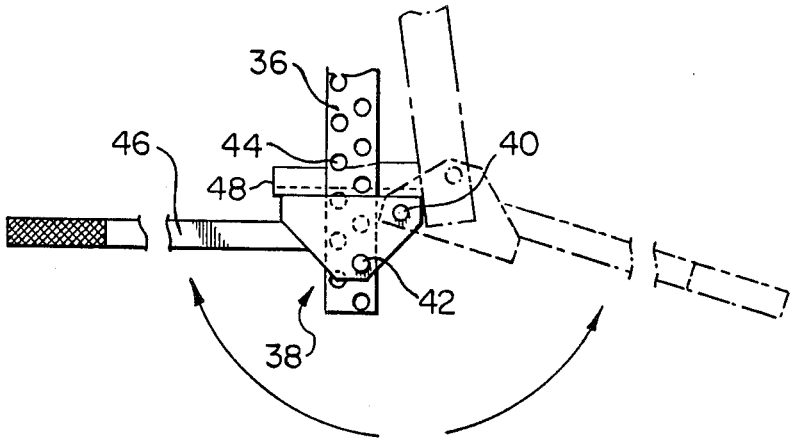
FIGS. 5 and 6 are respectively, partial plan and side section views of the spring adjustment means for the apparatus of the present invention.
Figure 6:
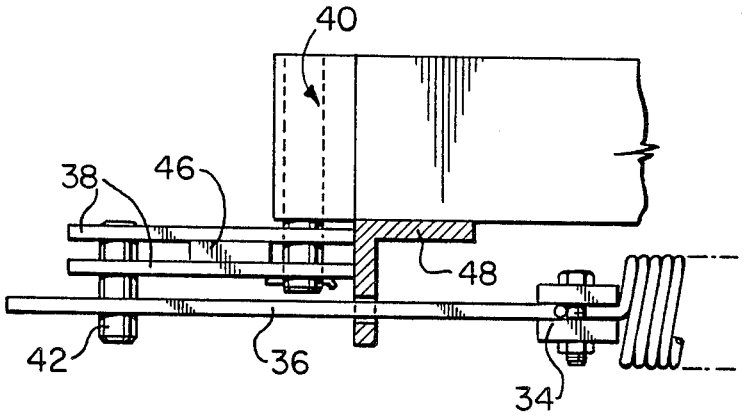

As can be seen for example in FIG. 4, the sideways motion of platform 16 is controlled by a spring assembly 24. One end of assembly 24 is secured to frame 4 as will be described in more detail hereinafter, and the other end is secured by means of cables 26 to extensions 28 secured to support bars 10 (FIG. 3). This arrangement provides biasing for platform 16 and support bars 10 and 12, the biasing tending to increase the forces acting on the platform to return it to central position as it moves to either side, away from that position. Spring assembly 24 comprises a plurality of elongated, horizontally positioned extension springs 30, one end of each of which is secured to puller bar 32 as illustrated in FIG. 4 and the other end of each of which is secured to an adjustable bar 34. One end of each of cables 26 is also secured to puller bar 32 as illustrated. A perforated tongue 36 is secured to adjustable bar 34 and is guided in a direction parallel to the longitudinal axes of springs 30 by a portion of frame 4. A hand jack 38 pivotally secured to a portion of frame 4 co-operates with tongue 36 to permit adjustment of bar 34. Hand jack 38, shown in detail in FIGS. 5 and 6, is a pair of plates which pivot about pin 40, to which plates perforated tongue 36 is connected by insertion of engaging pin 42 in appropriate hole 44 in perforated tongue 36 when hand jack 38 is in engaging position (phantom in FIG. 5). The user then pulls the hand jack handle 46 through a semi-circular path to the closed position, as shown in line in FIG. 5. This action causes tongue 36 and adjustable bar 34 to be drawn away from puller bar 32 a predetermined distance and causes springs 30 to be pre-stretched to create a desired degree of resistance, depending upon the location of the hole in the perforated tongue in which the engaging pin 42 is seated. Of course, as can be seen in (FIG. 5), when the hand jack 38 is in its closed position, it cannot open on its own to engaging position since the hand jack has passed top dead center with respect to pivot 40. It is held in this position by the force of springs 30. Angle iron 48 acts as a stop to prevent the motion of the hand jack beyond its closed position as illustrated and offers, at the same time, vertical restraint to tongue 36.

Resistance in the springs can also be decreased by removing one or more of extension springs 30 or increased by adding such springs.

To puller bar 32 are also secured the ends of delay extension springs 50 (FIG. 4). The other ends of these springs 50 are secured by means of wire rope 52 to perforated extension bar 54 secured to a portion of frame 4. Delay extension springs 50 are intended to provide increased resistance only when platform 16 is nearing the extremity of its sideways motion at the ends of its arc of travel, for example, when a heavy person is using the apparatus. Adjustment of the length of rope 52, or adjustment of its position secured in extension bar 54 will permit adjustment of the tension and timing of when that tension is exerted on puller bar 32. Rubber cord 53 is provided to collect wire rope 52 when loose. In addition, a further delay extension spring 55 is centrally secured to and extends between puller bar 32 and adjustable bar 34, if required. Being attached to adjustable bar 34, the force which it applies to the system may be varied according to the setting of the adjustable bar 34.

As can be seen in FIGS. 1, 2 and 4, cables 26 extend from their connections to puller bar 32 each around a lower pulley 56 and an upper pulley 58, down to an extension 28 (FIG. 3) secured to support bar 10. Each support bar 10 has an extension 28 secured to it. With this arrangement, regardless of the side to which platform 16 and support bars 10 move away from the central position, increasing tension is applied progressively to support bars 10 by way of cables 26, as the platform 16 moves an increasing distance from that central position. Pulleys 60 seated beside upper pulleys 58 serve to guide cables 26 and equalize as much as possible the forces exerted by spring assembly 24 on support bars 10 and platform 16 when platform 16 is on the left side of its path of travel, with the forces exerted by spring assembly 24 when platform 16 is on the right side of its path of travel. As can be seen in FIG. 3, upper pulleys 58 and guide pulleys 60 are secured to a centrally disposed post 62 which is secured to frame 4 at its lower end.

Figure 8:
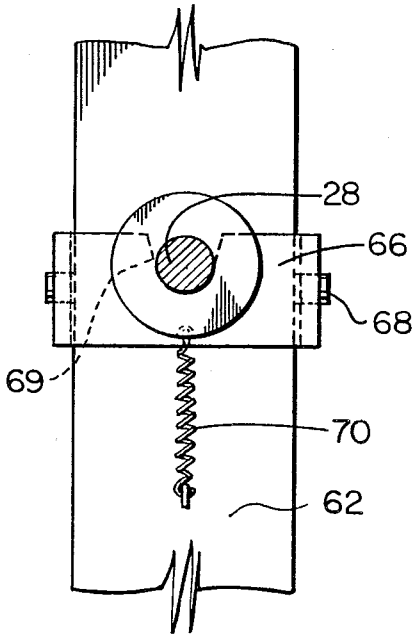
FIGS. 7 and 8 are enlarged partial views respectively, from the side and front of a locking means for immobilizing the apparatus of FIG. 1 in central position.
Figure 7:
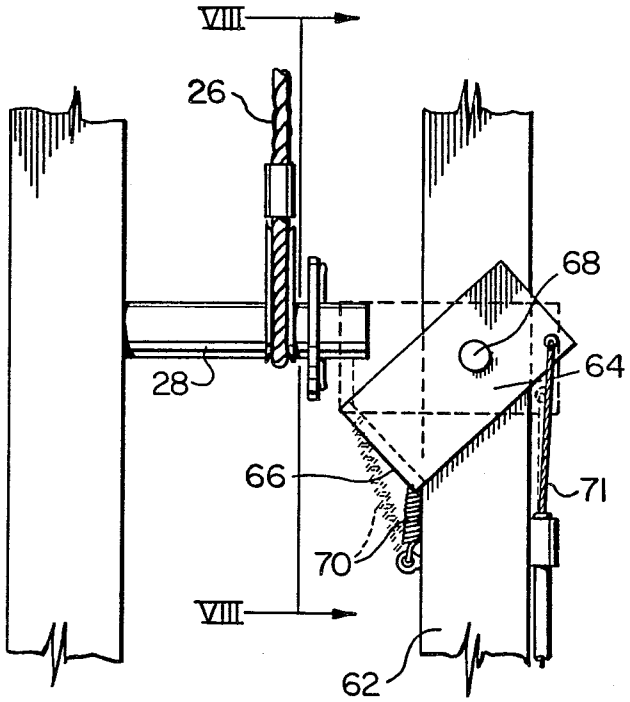

To immobilize platform 16 when the apparatus is not in use or when a user is getting on or off platform 16, a platform lock mechanism 64 is provided (FIGS. 7 and 8). This mechanism comprises a steel plate 66 which is pivotally secured to post 62 by pivot pins 68. Plate 66 has a notch 69 which engages extension 28 from one of the bars 10 when the platform is in inoperative position, with platform 16 in horizontal position as illustrated in FIG. 2. A spring 70 may be used to urge lock mechanism 64 away from locking position and maintain it in unlocked position as illustrated in FIG. 7. An appropriate lock actuation mechanism such as a cable 71 secured at one end to lock mechanism 64 and at its other to a handle mounted lock means 72 (FIG. 2) may be provided to lock and maintain in locked position lock mechanism 64.

Rubber cushion blocks 73 may be attached to frame 4 as illustrated (FIG. 2) to gently stop the downward motion of platform 16 if it is fully deflected.

Secured to frame 4 are a pair of handles 74 set in normal ski pole grip positions. These handles are mounted on an integral frame members 76. The handles are adjustable as illustrated and can be positioned closer or further from foot beds 20 to provide adjustability for skiers with different arm lengths and different horizontal body projections when bent over in skiing position. Handles 74 on frame members 76 are robust and provide balance, centering and recovery functions.

OPERATION

The apparatus according to the present invention is intended to provide a useful training and exercise device for both recreational and competitive alpine skiers. As previously indicated, it has been constructed to simulate as much as reasonably possible the motions and forces involved in making turns in alpine skiing. This has been accomplished, in accordance with the present invention, by placing the sideways-pivotable foot beds 20 on platform 16 which is secured by relatively long links (support bars 10 and 12) to frame 4, and thereby travels in a semi-circular path about a horizontal axis. This provides a lateral motion for the feet as well as an accentuated degree of forced vertical motion. Also as a alpine skier is in the middle and end of a turn, his or her ankles must be turned inwardly with respect to the center of curvature of the turn to provide proper edging and leg motion within the turn and thereby offset centrifugal forces which would otherwise throw the skier outwardly during the turn. This proper ankle motion is achieved on the apparatus by the outward tilt of the platform 16 at the limit of its swing to each side, which necessitates the user's inward pivoting of his or her ankles and feet to maintain balance.

Additionally, when a skier is doing a series of fast turns, the skier's legs (and particularly the outside leg) are extended during the turn and retracted under the body between the turns. This requires a significant up and down motion in the legs, which motion is achieved by the accentuated vertical motion of the platform as it passes from side-to-side through its central position.

In operation, the device may be immobilized in its central position by activation of lock mechanism 64 and lock means 72. A user steps onto foot beds 20 and straps his feet into the foot beds with straps 21. The lock means 72 is then manipulated to open lock mechanism 64, permitting the user to move platform 16 from side-to-side in arcuate fashion. The user supports himself by gripping handles 74. Platform 16, as it moves increasingly away from its normal inoperative position towards one side or the other comes under increasing tension from spring assembly 24 to return to that inoperative position, until the platform finally stops its sideways movement and commences to move in the opposite direction. The platform tilts outwardly causing the user's feet and foot beds to pivot inwardly as the platform 16 moves to one side or the other, providing proper orientation for the ankles and feet. As well, because of the accentuated degree of vertical motion of the platform as it moves from side-to-side, this apparatus also assists in the flexing of legs and shifting of weight necessary in a skier's turning. Of course, frame 4 is laterally elongated to provide lateral support for the apparatus during operation.

The combination of lengthy foot bed travel in both vertical and lateral motion, and accurate resistance adjustability permitted by the apparatus, allow the simulation of short radius, short period turns or long radius, long period turns depending on the desired action by the user. Short radius/short period turns are simulated by keeping the body centered and deflecting platform 16 from side-to-side using accentuated lower body movements. Long radius/long period turns are simulated by shifting the entire body weight from side-to-side. The width between foot beds 20 may be appropriately adjusted by moving the footbeds closer together or farther apart on platform 16 as required to accomodate different statures and balancing abilities. This feature combined with the adjustability of handles 74 permits selective weight distribution between feet during simulation on the apparatus, in that the force applied to the outside leg of the user can be varied.

In addition, the device according to the present invention provides the resistance offered through spring assembly 24 to be measured and accurately adjusted in small increments. This allows an accurate degree of adjustability for users of different weights, strengths and abilities.

As well, the tilting foot beds may be provided, by changing of rubber cushions 73, with variable tilt resistance to simulate edging forces during turns. This adjustable tilt resistance will allow skiers with different weights and strengths to adjust the foot beds 20 so that they are both stable when centered and tilted with a relative degree of simulated edging force.

Thus it is apparent that there has been provided in accordance with the invention a ski machine that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An exercising and training apparatus particularly for use for training alpine skiers, the apparatus comprising:

(a) a rigid frame;

(b) a platform for the feet of a user;

(c) elongated bar means pivotably secured to and extending between the platform and the frame to permit the platform to move, during operation from side-to-side, from a central position through a convex arcuate path, to provide forced lateral motion and an accentuated degree of forced vertical motion for the user's feet, and to tilt the platform during operation to the outside as it moves through its arcuate path;

(d) biasing means comprising spring, cable and pulley means, the spring and cable means secured to the frame, the cable means secured to the spring means and extending around the pulley means and secured to the elongated bar means, the spring, cable and pulley means arranged to provide increased resistance to the motion of the platform as it moves, during operation, an increased distance sideways in either direction away from the central position and to finally stop that sideways movement and cause the platform to move in the opposite direction; and (e) rigid user support means secured to the frame to be gripped by the user for balance during operation of the apparatus.

2. An apparatus according to claim 1 wherein the pair of elongated bar means are spaced from each other to form, with the base and platform, when the platform is in central position, a trapezoid.

3. An apparatus according to claim 2 wherein each bar means comprises a pair of parallel, transversely spaced bars.

4. An apparatus according to claim 2 wherein the spring means of the biasing means comprises an elongated extension spring means, one end of which is secured to the frame and the other end of which is secured by cable means to the elongated bar means.

5. An apparatus according to claim 4 wherein the extension spring means comprises a plurality of aligned, elongated extension springs, one end of each of which is secured to the frame and the other end of each of which is secured to a rigid bar normal to the longitudinal axes of the springs and movable in the direction parallel to the longitudinal axes of the springs, this bar being mechanically associated with the elongated bar means by the cable means.

6. An apparatus according to claim 5 wherein said one end of each of the springs which is secured to the frame is secured to a bar which is adjustably securable by securing means in a plurality of positions spaced in a direction parallel to the longitudinal axes of the springs.

7. An apparatus according to claim 5 wherein one or more of the extension springs are arranged to be under or little no tension except when the platform and elongated bar means near the limits of their arcuate motion to one side or the other, to provide significantly increased resistance to movement at these extreme positions.

8. An apparatus according to claim 5 wherein the cable means comprises a pair of cables one end of each of which is secured to the movable bar and the other end of each of which is secured to one of the bar means.

9. An apparatus according to claim 4 further provided with adjustment means to permit adjustment of the tension on the spring means.

10. An apparatus according to claim 9 wherein the end of the spring means which is secured to the frame is secured to a bar which is adjustably securable with respect to the frame at a plurality of positions in a direction parallel to the longitudinal axis of the spring means.

11. An apparatus according to claim 1 wherein the user support means secured to the frame comprises a handle bar providing hand-gripping portions positioned where ski poles would normally be positioned when a user is in operative position on the apparatus.

12. An apparatus according to claim 11 wherein adjustment means are provided for securely positioning the handle bar in a variety of positions.

13. An apparatus according to claim 1 wherein a pair of foot beds are secured to the platform to receive and support the user's feet during operation of the apparatus.

14. An apparatus according to claim 13 wherein each of the foot beds is pivotably supported on the platform for pivotal movement of the foot beds from side-to-side.

15. An apparatus according to claim 1 wherein a releasable lock means is provided to immobilize the platform in central position against unintended displacement of the platform from side-to-side.

16. An apparatus according to claim 1 wherein said pulley means are secured centrally, with respect to the central position of the platform, to the frame, the cable means being secured to the elongated bar means below said pulley means whereby, regardless of the side to which the platform and the elongated bar means move away from the central position during side-to-side movement of the platform and elongated bar means, said cable means exerts increasing tension progressively on the elongated bar means to provide said increased resistance to the motion of the platform.

17. An apparatus according to claim 1 wherein said spring means comprises a plurality of springs, one or more of said springs being arranged to be under little or no tension except when the platform and platform support means are near the limits of their arcuate motion to one side or the other, to provide significantly increased resistance to movement at these extreme positions.

* * * * *